US006852198B1

(12) United States Patent
Yamazaki et al.

(10) Patent No.: US 6,852,198 B1
(45) Date of Patent: Feb. 8, 2005

(54) RESIN COMPOSITION, WATER-RESISTANT/MOISTURE-PROOF PAPER, CONTAINING THE SAME, AND PROCESS FOR PRODUCING THE SAME

(75) Inventors: Yukinobu Yamazaki, Osaka (JP); Michinori Nakamoto, Osaka (JP); Hiroshi Okamura, Osaka (JP); Takeshi Yoshida, Osaka (JP); Hiroshi Kawahara, Osaka (JP)

(73) Assignee: Goyo Paper Working Co., Ltd., Osaka (JP)

( * ) Notice: Subject to any disclaimer, the term of this patent is extended or adjusted under 35 U.S.C. 154(b) by 0 days.

(21) Appl. No.: 10/019,301

(22) PCT Filed: Jul. 6, 2000

(86) PCT No.: PCT/JP00/04513

§ 371 (c)(1),
(2), (4) Date: Jan. 7, 2002

(87) PCT Pub. No.: WO01/04209

PCT Pub. Date: Jan. 18, 2001

(30) Foreign Application Priority Data

| | | |
|---|---|---|
| Jul. 8, 1999 | (JP) | 11/194060 |
| Oct. 28, 1999 | (JP) | 11/306510 |
| May 19, 2000 | (JP) | 2000/147642 |

(51) Int. Cl.[7] ..... D21H 21/16; D21H 19/80; D21H 19/46; D21H 19/56

(52) U.S. Cl. ..... 162/169; 162/124; 162/127; 162/162; 162/164.1; 162/173; 162/180; 162/181.1; 106/236; 106/241; 106/901; 428/355.1; 428/511

(58) Field of Search ..... 106/218, 230, 106/236, 241, 270–272, 901; 428/500, 507, 511–518, 343, 348, 349, 351, 355 EN; 162/103, 104, 134–137, 157.4, 164.1, 168.1, 169, 172, 173, 180, 184; 427/207.1, 209, 300, 302, 303, 324–326, 384, 385.5, 389.9, 391, 394, 395, 411, 412, 412.3, 413, 416, 417; 430/531, 534, 536, 538

(56) References Cited

U.S. PATENT DOCUMENTS

| | | | | | |
|---|---|---|---|---|---|
| 3,893,883 | A | * | 7/1975 | Higuchi et al. | 156/334 |
| 4,086,116 | A | * | 4/1978 | Yazaki et al. | 156/205 |
| 4,087,505 | A | * | 5/1978 | Sugimoto et al. | 264/564 |
| 4,362,784 | A | * | 12/1982 | Kato et al. | 428/340 |
| 5,024,888 | A | * | 6/1991 | Hwo et al. | 428/355 EN |
| 5,106,692 | A | * | 4/1992 | Shigemoto | 428/412 |
| 5,328,749 | A | * | 7/1994 | Noda et al. | 428/32.2 |
| 5,441,999 | A | * | 8/1995 | Jarvis et al. | 524/271 |
| 5,454,909 | A | * | 10/1995 | Morganelli | 162/55 |
| 5,466,519 | A | * | 11/1995 | Shirakura et al. | 428/323 |
| 6,025,032 | A | * | 2/2000 | Gaveske | 427/393.6 |
| 6,159,404 | A | * | 12/2000 | Edwards et al. | 264/171.1 |
| 6,333,119 | B1 | * | 12/2001 | Mito et al. | 428/511 |

FOREIGN PATENT DOCUMENTS

| | | | |
|---|---|---|---|
| JP | 61-97496 | 5/1986 | |
| JP | 2-4160 | 1/1990 | |
| JP | 09-316252 | 12/1997 | |
| JP | 9-316252 | * 12/1997 | C08L/23/12 |
| JP | 11-158330 | 6/1999 | |

OTHER PUBLICATIONS

Physical constants for titanium dioxide and calcium carbonate from CRC Handbook of Physics and Chemistry, 71st ed., 1990–1991.*

* cited by examiner

*Primary Examiner*—Steven P. Griffin
*Assistant Examiner*—Eric Hug
(74) *Attorney, Agent, or Firm*—Armstrong, Kratz, Quintos, Hanson & Brooks, LLP

(57) ABSTRACT

Disclosed is a resin composition for water-resistant and moisture-proof paper comprising 40 to 75 parts by weight of a polyolefin (A), 25 to 60 parts by weight of a tackifier (B) and 0 to 20 parts by weight of a compatibilizing agent (C), the total of (A), (B) and (C) being 100 parts by weight, and further blending 20 to 300 parts by weight of an inorganic filler (D) to 100 parts by weight of the sum of (A), (B) and (C). According to the present invention, the water-resistant and moisture-proof paper is provided at low cost which is disaggregated with ease by a pulper and recycled as paper materials.

34 Claims, No Drawings

RESIN COMPOSITION, WATER-RESISTANT/MOISTURE-PROOF PAPER, CONTAINING THE SAME, AND PROCESS FOR PRODUCING THE SAME

TECHNICAL FIELD

The present invention relates to a resin composition for a water-resistant and moisture-proof paper (hereinafter referred to as "resin composition"), a water-resistant and moisture-proof paper made using the foregoing composition, and to a method for producing the foregoing paper.

BACKGROUND ART

Generally, as water-resistant and moisture-proof paper, paper coated with a polyolefin type resin such as polyethylene, polypropylene or the like is well known and widely used. This water-resistant and moisture-proof paper extrusion-laminated with such a polyolefin type resin not only has excellent water-resistance, moisture-proofness and processability, but also is economical and remarkably excellent as water-resistant and moisture-proof paper. For this reason, this paper is in wide use as a wrapping paper for paper products requiring moisture-proofness, packages for plastic pellets, salt and the like. Moreover, in this industry, there is also moisture-proof paper called clad paper or poly-sandwiched type, in which two sheets of paper are bonded with the polyolefin resin sandwiched therebetween. Further, the polyolefin resin is excellent in water-resistance and heat-sealability and is thus easily processable, it is widely used as paper cups for drinks and cow's milk packages, too.

On the other hand, from a view point of recycling property, that is, wastepaper regenerability, the mechanical strength of the laminated film of the moisture-proof layer of the water-resistant and moisture-proof paper coated with a polyolefin is too high and therefore, a pulper to be employed in a process of regenerating paper and carrying out pulping cannot finely disperse the polyolefin type resin layer parted from the fibrous part of the paper and leaves the resin layer as blocks and films, and they are stuck to a drying roll of a paper making machine or adheres to the surface of regenerated paper or causes bleeding and surface roughness to thus make recycling of wastepaper impossible. Accordingly, in this industry such paper coated with a polyolefin resin is positioned as taboo products of non-recyclable materials, together with photos, laminate labels or the like. In addition, in recycling milk packages, every endeavor is made to beforehand remove a polyethylene film coated.

Further, in light of moisture-proof paper possible to be recycled being demanded, moisture-proof paper coated with an emulsion containing a synthetic rubber latex or an acrylic emulsion and a wax emulsion has recently been proposed. Although this moisture-proof paper is certainly excellent in moisture-proofness and also in recycling property as wastepaper, since the coating liquid is an aqueous emulsion, large scale drying facilities are required to form the coating layer, which leads to increase both in equipment cost and in energy cost and the productivity is inferior as compared with the case of laminating with a polyolefin type resin. In addition, with proceeding of the drying and the coating film of a moisture-proof layer, the moisture-proof paper is sometimes curled and the wax in the coating layer sometimes bleeds, and slippage sometimes occurs between moisture-proof papers. Moreover, in the case where the obtained moisture-proof paper is rolled like a coil, since the face of the moisture-proof layer is brought into contact with the opposed face in which no moisture-proof layer is formed, the wax components contained in the moisture-proof layer are transferred to the opposed face, which results in problems that slippage is considerably easily caused. Moreover, it is pointed out that the wax layer is formed on the surface of the moisture-proof layer so that printing with an aqueous ink is impossible and an emulsion adhesive for packaging paper can not be used. Further, in recycling of wastepaper, water-soluble ingredients forming the emulsion dissolve into a waste liquid for manufacturing paper and thus the treatment of the waste liquid becomes difficult.

Moisture-proof paper is also proposed which blends a large amount of a flat-shaped inorganic filler into the aforementioned latex or emulsion to make use of moisture-proofness of the inorganic filler. By blending the flat-shaped inorganic filler, most of drawbacks caused by the wax are solved, but a fresh problem is brought about by the inorganic filler blended in a large amount is pointed out. That is, those are fatal drawbacks as a wrapping paper that the moisture-proofness at a folded part of the moisture-proof paper is liable to lower and that the surface of paper products wrapped tends to be damaged by the inorganic filler. In addition, the difficulty in waste water treatment is not solved.

Moreover, in the case of the moisture-proof paper using a latex or emulsion type moisture-proof liquid, there are many problems when it is used for foods in direct contact with the moisture-proof layer. That is, since an emulsifier, a film-forming agent or the like contained in the latex or emulsion remains in the moisture-proof layer, there is a fear of transferring them to the foods. In addition, there is a problem with respect to water resistance caused by the influence of those residual impurities.

The purpose of the present invention is to solve the conventional drawbacks as mentioned above and to provide a resin composition for obtaining a water-resistant and moisture-proof paper which can be disaggregated and a water-resistant and moisture-proof paper using the composition.

In light of the numerous problems included in a polyolefin-laminated moisture-proof paper which is widely used but cannot be disaggregated, the present inventors have made an extensive series of studies on a resin composition which can be disaggregated and have found out that by blending a large amount of a tackifier with a polyolefin resin, it is possible to obtain a water-resistant and moisture-proof paper which can be disaggregated by a pulper or the like, while making use of the excellent moisture-proofness of the polyolefin resin.

The resin composition in a first aspect of the present invention does not require a large amount of a wax or an inorganic filler as an indispensable component so that it is free from slippage and a decrease in heat resistance caused by the wax. Moreover, it does not require an inorganic filler of a specific shape, either, and thus it has numerous advantages that it is free from a decrease in moisture permeability at the folded portion and a damage of the surface of paper products wrapped, or the like.

Further, since the resin composition does not contain water-soluble harmful substances such as an emulsifier and a film-forming agent, there is little substance dissolving into water for making paper when pulped for the regeneration of wastepaper, which does not increase a load to the treatment of waste water.

The resin composition in a second aspect of the present invention not only solves the problem of high expense of the foregoing resin composition as compared with the conventional polyethylene-laminated moisture-proof paper by blending an inorganic filler, but also solves the drawbacks associated with the conventional moisture-proof paper making use of the moisture-proofness of an inorganic filler, i.e., fatal problems as a wrapping paper such as a decrease in moisture-proofness at the folded part and damage of the surface of paper products wrapped.

DISCLOSURE OF THE INVENTION

The present invention provides, in a first aspect, a resin composition for water-resistant and moisture-proof paper comprising 40 to 75 parts by weight of a polyolefin (A), 25 to 60 parts by weight of a tackifier (B) and 0 to 20 parts by weight of a compatibilizing agent (C), the total of (A), (B) and (C) being 100 parts by weight.

The present invention provides, in a second aspect, a resin composition for water-resistant and moisture-proof paper comprising 40 to 75 parts by weight of a polyolefin (A). 25 to 60 parts by weight of a tackifier (B) and 0 to 20 parts by weight of a compatibilizing agent (C), and 20 to 300 parts by weight of an inorganic filler (D) to the total amount of 100 parts by weight of (A), (B) and (C).

The present invention provides, in a third aspect, a water-resistant and moisture-proof paper, wherein a water-resistant and moisture-proof layer of the resin composition of the present invention is formed on either one side of a paper substrate.

The present invention provides, in a fourth aspect, a water-resistant and moisture-proof paper, wherein a coat layer of a (meth)acrylic resin is formed on the water-resistant and moisture-proof layer of the resin composition of the present invention.

The present invention provides, in a fifth aspect, a water-resistant and moisture-proof paper, wherein the resin composition of the present invention is inserted between paper substrates of not less than two sheets.

The present invention provides, in a sixth aspect, a method for producing water-resistant and moisture-proof paper, comprising the step of forming a water-resistant and moisture-proof layer by applying the resin composition of the present invention to at least one side of a paper substrate.

The present invention provides, in a seventh aspect, a method for producing water-resistant and moisture-proof paper, comprising the steps of:

forming a moisture-proof layer by applying the resin composition of the present invention to at least one side of a paper substrate, and forming a coat layer of a (meth)acrylic resin on the surface of the water-resistant and moisture-proof layer.

The present invention provides, in a eighth aspect, a method for producing moisture-proof paper, comprising the step of:

forming a water-resistant and moisture-proof layer by applying the resin composition of the present invention between paper substrates of not less than two sheets.

BEST MODE FOR CARRYING OUT THE INVENTION

The resin composition in a first aspect of the present invention encompasses a resin composition for water-resistant and moisture-proof paper comprising 40 to 75 parts by weight of a polyolefin (A), 25 to 60 parts by weight of a tackifier (B) and 0 to 20 parts by weight of a compatibilizing agent (C), the total of (A), (B) and (C) being 100 parts by weight. Hereinafter, the resin composition in a first aspect will be explained.

The polyolefins used in the present invention are generally classified into (1) to (3) as follows:

(1) First, amorphous polypropylene (APP) collected as byproducts after the polymerization of propylene, non-crystalline olefinic polymers (amorphous polyalphaolefins: APAO) such as propylene homopolymers and copolymers of propylene and ethylene, butene-1 or the like. The molecular weight of these polymers is preferably not less than approximately 100. If it is less than 100, the strength of the moisture-proof layer tends to be insufficient. More preferably, propylene homopolymers having a weight average molecular weight of not less than 10000 and copolymers of propylene and at least one selected from alphaolefins such as ethylene and butene-1 are used.

(2) Second, polypropylene resins widely used as polypropylene molding materials are exemplified. As the crystalline resins, a homopolymer type such as propylene homopolymers, a random copolymer type such as copolymers with ethylene, etc., and a block copolymer type such as block copolymers. In addition, a polymer alloy type with the other kinds polymers is also commercially available as polypropylene resins. Those are all used in the present invention. It is preferred to use those having an MFR (JIS K7210, 230° C.) of 1 g/10 min or more, which are in use for extrusion, lamination, injection molding and non-woven cloth. It is also preferred to use crystalline polypropylene resins of a low molecular weight for the adjustment of viscosity or the like.

Moreover, it is also preferred to use non-crystalline to low crystalline polypropylene copolymers containing 50 mol % or more of propylene, which are used as modifying resins of polyolefins. The copolymer resins of propylene and alphaolefins are well known and those having an MFR (ASTM D1238, 190° C.) of 1 g/10 min or more are suitably used. In some cases, those are blended and supplied as polypropylene block copolymers.

(3) Third, polyethylene resins are exemplified. Generally, those are classified into low density polyethylene (linear low density polyethylens are also included), middle density polyethylenes and high density polyethylenes. Those are all used in the present invention. As part of the polypropylene resins, polyethylene resins are sometimes blended. In order to avoid a decrease in heat resistance, the polyethylene resin is preferably not more than 50% by weight of the polyolefin.

The polyolefin is used singly or in combination of two or more. It is preferred to use a propylene homopolymer or an amorphous polyalphaolefin comprising a copolymer of propylene and ethylene or butene-1 since it is excellent in flexibility of the water-resistant and moisture-proof layer and in water-resistance and moisture-proofness. It is also preferred to use a crystalline polypropylene resin alone to enhance heat resistance of the water_resistant and moisture-proof layer. It is more preferable to use two or more of the polyolefins not only to improve disaggregation and moisture permeability while preventing cracks of the water-resistant and moisture-proof layer, but to make compatible heat resistance and antiblocking property. The polyolefin does not have water absorption and its film is excellent in water-resistance.

The amount of the polyolefin is 40 to 75 parts by weight, preferably 45 to 70 parts by weight. In the case of less than 40 parts by weight, the strength of the water-resistant and moisture-proof layer is insufficient and thus the water-resistant and moisture-proof layer is destroyed to result in a decrease in water-resistance and moisture-proofness. In the case of more than 75 parts by weight, the disaggregation lowers to result in a drawback in recycling as wastepaper.

As the tackifier (B) used in the present invention, there are included rosin, modified rosins, their ester compounds, alkylphenol resins, alkylphenol-modified xylene resins, rosin-modified xylene resins, terpene phenol resins and the like as ones having a functional group, and terpene type resins such as terpene resin and aromatic modified terpene resins, olefin type resins, styrene type resins, petroleum resins, hydrogenated petroleum resins, coumarone-indene resins or the like as ones having no functional group. Any of those can be selected and those compounds may be used singly or as a mixture of two or more. Among them, especially preferable are aromatic and alicyclic petroleum resins, terpene phenol resins, aromatic modified terpene resins, rosin esters or the like since those have compatibility with a polyolefin and become an almost transparent solution when dissolved at high temperature. Moreover, for the application of food, hydrogenated alicyclic petroleum resins, hydrogenated terpene resins and hydrated rosin esters are preferably used, in particular.

The amount of the tackifier to be used is 25 to 60 parts by weight, preferably 30 to 55 parts by weight. In the case of less than 25 parts by weight, the disaggregation is insufficient and in the case of more than 60 parts by weight, the moisture-proofness is deteriorated.

As the compatibilizing agent (C) used in the present invention, first, there are exemplified oxidized polyolefins, acid-modified polyolefins or the like, which are obtained by partially oxidizing polyethylene, polypropylene and these copolymerized olefin resins, or by reacting a carboxylic acid group such as maleic anhydride and itaconic anhydride with these polyolefins, and among those, polypropylene grafted with maleic anhydride which is mass-produced is preferred to use.

As a second compatibilizing agent between two or more polyolefins, hydrogenated styrene-butadiene resins, styrene (olefin)-ethylene butylene-olefin block copolymer resins or the like are exemplified. These are suitably used, too. The compatibilizing agent may be used singly or in combination of two or more.

The amount of the compatibilizing agent is 0 to 20 parts by weight. Even in the case of zero part by weight, the resin composition may be used practically, but since an adhesion-improving effect to a penetration-proof agent or the like is insufficient, the amount in a range of 1 to 7 parts by weight is preferred. In the case of more than 20 parts by weight, heat stability worsens.

In the present invention, the sum of the amounts of the respective components (A) to (C) is 100 parts by weight.

It is preferred to blend an inorganic filler with the resin composition of the present invention to thus adjust the density of the resin composition to 1.0 g/cm$^2$ or more, since the resin C) composition floating up in pulp liquid when the water-resistant and moisture-proof paper is disaggregated as wastepaper can be reduced, and the surface of the recycled paper becomes uniform.

The inorganic filler is not specifically limited, and, for example, calcium carbonate, mica, talc, silica, barium sulfate, wollastonite, kaolin, clay or the like are exemplified, and these may be used singly or in combination of two or more. In general, most of inorganic fillers have a density of 2.4 g/cm$^3$ or more, and thus it is preferred to add not less than 5 parts by weight to the resin composition.

The resin composition of the present invention may further contain a wax with a view to controlling the melting viscosity and improving the antiblocking property of the resin composition. If the amount of the wax is too plenty, the slippage caused by transferring of the wax to the rear side of the water-resistant and moisture-proof paper becomes large, and the heat resistance lowers, though the moisture-proofness is enhanced, and therefore, that is not desired.

As the wax used in the present invention, there are included natural waxes such as paraffin wax, microcrystallin wax, montan wax, carnauba wax, candelilla wax and Fischer-Tropsch wax. These may be used singly or in combination of two or more.

The amount of the wax is not more than 10 parts by weight, though varying with the blending ratio of the resin composition.

When the water-resistant and moisture-proof paper is disaggregated by a pulper in a paper producing company and regenerated as wastepaper, it is preferred to color the resin composition to almost the same color as the paper substrate used, since the resin composition remained on the recycled paper is difficult to be seen to thus suppress a decrease in quality of the recycled paper. The level of coloring may not be so strict and it is preferred that the color of the resin composition is almost identical to or a little lighter than that of the paper substrate used. If it is deeper, the presence of the resin composition on the recycled paper becomes noticeable.

The resin composition of the present invention may further be added with stabilizers such as an antioxidant, viscosity-adjusting agents, lubricants, antiblocking agents, antistatic agents and other additives for the purpose of improving processability or the like.

After the water-resistant and moisture-proof layer of the resin composition of the present invention was formed on a paper substrate, a coat layer of a (meth)acrylic resin can be formed further on the water-resistant and moisture-proof layer. The coat layer is effective for an improvement in antiblocking of the water-resistant and moisture-proof layer, prevention of transference of minor substances to paper products wrapped, impartation of antislipping property and increase in adhesion of a wrapping glue. As the (meth) acrylic resin, copolymer resins comprising methyl meth-acrylate and (meth)acrylic acid, acrylic acid ester, styrene or the like are suitably used. Both a solution type dissolved in a solvent and an emulsion type dispersed in water may be used. When the main component is of a (meth)acrylic resin, a poly (styrene-butadiene) latex may be conjointly used.

The coat layer is formed by being coated on the water-resistant and moisture-proof layer by various coaters followed by drying a solvent. The thickness of the coat layer is preferably 0.1 to 3.0 g/m$^2$.

As additives to the (meth)acrylic resins of the coat layer, there are exemplified inorganic fillers for the prevention of slippage, a small amount of waxes for the improvement of antiblocking, antistatic agents for the removal of static electricity, delustrants for the improvement of surface appearance, colorants for making imperceptible the resin composition and/or the coat agent left on the recycled wastepaper, on the like. These may be used, if necessary, singly or in combination of two or more.

In the present invention, the abovementioned resin composition is inserted like a sandwich between paper substrates to provide a clad paper type (polysandwiched type) water-resistant and moisture-proof paper. The polysandwiched type water-resistant and moisture-proof paper is produced with ease by applying a molten resin composition of the present invention to one paper substrate, and providing the other paper substrate to be in contact of the molten resin before it is cooled, then those are pressurized for bonding. Moreover, it is also possible to produce the polysandwiched type water-resistant and moisture-proof paper by bonding a paper substrate or a water-resistant and moisture-proof paper to another water-resistant and moisture-proof paper, at one side of which a water-resistant and moisture-proof layer is formed with heat or an adhesive. It is further possible to provide the polysandwiched type water-resistant and moisture-proof paper by paying out two sheets of water-resistant and moisture-proof paper simultaneously, extruding a molten resin composition of the present invention between the two sheets of paper from a dice of an extrusion laminating machine to thus conduct polysandwich processing.

In the present invention, it is preferred to form a penetration-proof layer by applying a penetration-proof agent to one or both faces of a paper substrate to be in contact with a resin composition of the present invention, that is, the face of the paper substrate on which the resin composition is formed or both this face and the face of another counterpart paper substrate in contact with the resin composition in order to prevent deterioration of water-resistance, moisture-permeability and disaggregation caused by excess soaking of the resin composition. The same applies to the case where two sheets of paper substrates are bonded in sandwich-shape.

As the penetration-proof agent, there are included a solvent solution of (meth)acrylic polymers, styrene-butadiene polymers, vinyl acetate polymers, chlorinated polyolefins or the like, an emulsion of (meth)acrylic polymers, vinyl acetate polymers, vinylidene chloride polymers or the like, and a latex of SBR, NBR, or the like.

To select the penetration-proof agent, it is important for it to have an excellent adhesive property to the resin composition of the present invention. Since the adhesive property is improved by using the resin composition containing a compatibilizing agent (C), the penetration-proof agent can be selected from a wide range of options.

The amount of the penetration proof agent is generally 0.1 to 20 g/m$^2$ and preferably 0.5 to 5 g/m$^2$ in terms of adhesive strength and the disaggregation.

Further, by mixing an inorganic filler to the penetration-proof agent, the penetration-proof agent resin component can be lessened and the filler is suppressed from penetrating into a paper substrate to heighten the effect of preventing penetration. As the inorganic filler, such inorganic fillers as aforesaid are usable and the average particle diameter of the inorganic filler is preferably 2 $\mu$m or smaller for the coated thickness to be smaller. The addition amount of the inorganic filler is preferably 20 to 200 parts by weight to 100 parts by weight of the penetration proof agent resin components. The penetration-proof agent may further be added with antioxidants, viscosity-adjusting agents, colorants or the like.

The water-resistant and moisture-proof paper of the present invention is obtained by applying the resin composition to at least one side of a paper substrate. The amount of the resin composition to be applied may be suitably determined according to the desired water-resistance and moisture-proofness, but is, in general, preferably 10 to 50 g/m$^2$. The moisture permeability of the moisture-proof paper is said to be 50 g/m$^2$. 24 hr or below, preferably 40 g/m$^2$. 24 hr or below (Measurement method: JIS Z 0208) and thus it is especially 16 to 25 g/m$^2$ in order to provide a cheap water-resistant and moisture-proof paper.

As the method for applying the resin composition of the present invention to a paper substrate, a coating system using coaters such as a roll coater, a slot orifice coater and an extrusion coater, and an extrusion laminating system using a T-die are used, and any applying method may be employed.

When the penetration-proof layer is formed, the penetration-proof agent is applied, prior to applying the resin composition of the present invention, to the face to which the resin composition is to be applied or the face of another counterpart paper substrate in contact with the resin composition or the both faces.

The resin composition in a second aspect of the present invention encompasses a resin composition for water-resistant and moisture-proof paper comprising 40 to 75 parts by weight of a polyolefin (A), 25 to 60 parts by weight of a tackifier (B) and 0 to 20 parts by weight of a compatibilizing agent (C), and 20 to 300 parts by weight of an inorganic filler (D) to the total amount of 100 parts by weight of (A), (B) and (C).

To the polyolefin (A), the tackifier (B) and the compatibilizing agent (C), the same applies as described in the resin composition in a first aspect of the present invention.

As the inorganic filler (D) used in the present invention is not specifically limited, and, for example, the inorganic filler used for adjusting the density of 1.0 g/cm$^3$ or more in the resin composition in a first aspect of the present invention can be used. That is, calcium carbonate, mica, talc, silica, barium sulfate, wollastonite, kaolin, clay or the like are exemplified. These may be used singly or in combination of two or more.

Though a cheap water-resistant and moisture-proof paper can be obtained by using the inorganic filler, when it is used in a large amount, it is necessary to consider the dispersibility with a polyolefin used. In the case of poor dispersibility, the strength of the water-resistant and moisture-proof layer remarkably lowers, and the water-resistance and moisture-proofness lower, too. From this viewpoint, it is preferred to use a surface-modified inorganic filler and an inorganic filler with an average particle size of 5 $\mu$m or below. As the surface-modified inorganic filler, inorganic fillers treated with silane coupling agents such as vinyltriethoxy silane, N-$\beta$-(aminoethyl)-$\gamma$-aminopropyl triethoxysilane, titanate and aluminate coupling agents or the like are exemplified, Moreover, if the recycling of the water-resistant and moisture-proof paper of the present invention as wastepaper is taken into consideration, it is preferred to use calcium carbonate, kaolin and clay since those are used in a large amount as materials for art paper and coat paper in a paper producing company and thus are not impurities.

When the inorganic filler is used in a large amount, the specific gravity of the resin composition greatly exceeds 1.0. Accordingly, it is feared that when the water-resistant and moisture-proof paper is disaggregated into a pulp liquid, the inorganic filler tends to precipitate at a lower layer of the pulp liquid to bring about a problem upon producing a recycled paper, However, in the case of art paper being a printing paper, about 40 g/m$^2$ of a coat layer comprising kaolin as the main component is provided on the both sides of a paper substrate of about 40 g/m$^2$ and a broke is recycled. From this fact, it is understood that the specific gravity of the resin composition is not so important quality problem if only the disaggregation is good.

The amount of the inorganic filler is 20 to 300 parts by weight, preferably 20 to 200 parts by weight to 100 parts by weight of the sum of the components (A) to (C). In the case of less than 20 parts by weight, a cost-reducing effect is insufficient and in the case of more than 300 parts by weight, a film-forming property of the water-resistant and moisture-proof layer deteriorates.

The water-resistant and moisture-proof paper of the present invention using the resin composition in a second aspect of the present invention and the production method thereof are the same as in the resin composition in a first aspect of the present invention.

The water-resistant and moisture-proof paper is useful for a recyclable wrapping moisture-proof paper of paper products and a package of plastic pellets, when it is applied to one side of a kraft paper as a paper substrate. The water-resistant and moisture-proof paper with the resin composition applied to one side of a bleached kraft paper and with the pattern printed on the opponent side thereof is useful for a recyclable wrapping paper of PPC (plain paper copier) paper.

Further, it is possible to provide a cheap and useful water-resistant and moisture-proof paper, e.g., polysandwiched type moisture-proof paper by extruding the resin composition from a T-die between two sheets of paper substrates paid out simultaneously from a laminating machine.

Furthermore, if a cup paper is coated with the resin composition and punched by the use of a cup-making machine, a paper cup which is recyclable and excellent in water-resistance can be obtained. An example of the production method is as follows:

(1) A water-resistant layer is formed on at least one side of a paper substrate by coating with the resin composition. The amount of the resin composition is determined depending upon the desired properties, but usually 10 to 50 g/m$^2$. The coating is made by a coating system using coaters such as a roll coater, a slot orifice coater and an extrusion coater, and a laminating system using a T-die or the like, but any coating system may be employed.

(2) The obtained cup paper, on at least one side of which is coated with the resin composition is supplied to a cup-making machine so that the water-resistant layer becomes a liquid-contacting surface, sterilized and cup-produced to thus provide a paper cup. It is also possible to print the outer surface beforehand and it is also possible to produce by using a production equipment enabling cup-making and filling simultaneously. The bonding upon the cup-making is conducted by hot plate heating, high-frequency heating, flame heating or the like, but fundamentally, heat sealing is employed. In molding a paper cup, with the water-resistant layer is an inside surface, a fan-shaped trunk (side wall) and a circular bottom are punched and heat sealed by a molding machine. Thereafter, it is subjected to a top curling to thus give a paper cup. It is also possible to print the outer surface beforehand.

Paper containers with an aluminium foil, a barrier resin layer or the like for the purpose of preventing the oxidation of a content, shading or the like are also known, but those are not applicable to the present invention, since the aluminium foil and the barrier resin layer disturb the recycling as wastepaper. However, if a barrier resin is water-soluble or capable of disaggregation in water, such combination technique may be applicable to the present invention.

Further, it is also possible to produce a paper container by using a water-resistant and moisture-proof paper on both surfaces of which the water-resistant and moisture-proof layers are formed. In this case, the permeation speed of water into the water-resistant and moisture-proof paper becomes slower when it is thrown into a pulper as wastepaper to thus result in slower disaggregation as compared with the case where the water-resistant and moisture-proof layer is formed only on one side, but it is possible to be recycled as a paper material without any practical problems.

Furthermore, it is also possible to produce a water-resistant and moisture-proof corrugated board container by applying a penetration-proof agent to a liner paper and coating it with the resin composition, processing and assembling by a corrugating machine. An example of the production method is as follows:

(1) On at least one side of a liner paper and a corrugated medium, i.e., on at least one side of a (Kraft) liner paper and a corrugated medium, a water-resistant and moisture-proof layer is formed. For example, without being limited to the innermost or outermost side, at least one side or the both sides of the facing inside surfaces of two sheets of the liner papers, a water-resistant and moisture-proof layer are formed and the liner papers and the corrugated medium are processed and bonded with a starch glue for a corrugated board container by a corrugating machine. Accordingly, the water-resistant and moisture-proof layer can be formed on the most preferable position according to uses. It is, of course, possible to form the water-resistant and moisture-proof layer not only to one side, but to both sides. Though it is possible to apply to the corrugated medium, usually, this is not adopted usually except the specific case, since a flute processing is conducted after applying. The amount applied is determined depending upon the desired properties, but in general, preferably 10 to 50 g/m$^2$. The coating is made by a coating system using coaters such as a roll coater, a slot orifice coater, an extrusion coater, and a laminating system using a T-die but any coating system may be employed.

(2) An upper liner paper (outer surface of a corrugated board), a lower liner paper (inner surface of the corrugated board) and a corrugated medium forming a flute are positioned in an ordinary corrugating machine, and those are subjected to a flute processing, bonding with a starch glue and drying in an ordinary production method. Printing and a cup making are carried out in an ordinary method.

Hereafter, the present invention will be described in detail with reference to examples, however the present invention is not at all limited to those examples.

In the following description, parts means parts by weight unless otherwise instructed.

EXAMPLE 1

A resin composition was produced by extruding, kneading and pelletizing by the use of a homodirectional double-screw extruder, a mixture comprising 40 parts of an amorphous polyalphaolefin (polypropylene homopolymer with weight average molecular weight of 70,000) (A1), 20 parts of a crystalline polypropylene [homopolymer MFR (JIS K 7210 at 230° C.)=38 g/10 min, melting point=157° C.] (A2) as the (A) component, 40 parts of a terpene-phenol copolymer resin (ring and ball softening point: 145° C., acid value: 1 or lower, and number average molecular weight: 1000) (BE) as the (B) component, and 1 part of a hindered phenol type antioxidant (melting point: 110 to 125° C.) as a stabilizer. The temperature of a dice was set at 170° C.

The obtained pellets were applied to one side of a kraft paper of 75 g/m$^2$ thickness using a single screw extruder in 20 g/m$^2$ thickness. The temperature of a T-die was set at 200° C.

The moisture permeability, disaggregation in water, and the antiblocking property of the obtained water-resistant and moisture-proof paper were measured by the following methods. As the results being shown in Table 1, the moisture permeability was excellent in a flat type and a type folded into a cruciform shape. Also, the disaggregation in water was excellent and bleeding of the manufactured paper by heating was not observed. Moreover, with respect to the antiblocking property, blocking was slightly observed.

The liquid (filtrate after a pulp component was used for paper making) was diluted to 0.5% of a pulp concentration in the actual paper making process for the measurement of COD and BOD. The COD was 2.5 ppm and the BOD was 2 ppm which were identical to the values in the case where only kraft paper was treated in the same manner. This indicates that the water-resistant and moisture-proof paper using the resin composition of the present invention does not allow oxidative substances and organic compounds to dissolve into water during the disaggregation.

(1) Moisture Permeability

The moisture permeability (flat and cruciform folding) was measured based on a cup method (JIS Z 0208). The cruciform folding is a moisture permeability measurement method for wrapping products requiring a very strict moisture-proofness and it is not described in JIS.

Folding into a cruciform shape means folding the center of a paper specimen into a cruciform shape and forming the folding lines by reciprocating a roller of 3 Kg one time on the folded lines. The moisture permeability was then measured. In general, if the moisture permeability is 50 g/m$^2$. 24 hr or lower, preferably 40 g/m$^2$. 24 hr or lower, the paper can be used as a moisture-proof paper.

(2) Disaggregation

Using a standardized pulp disaggregating apparatus made by Kumagai Riki Industrial Co., Ltd., the resin dispersibility of a pulp solution and the manufactured water-resistant and moisture-proof paper was determined by visual observation according to the following standards after specimens were cut into 1 to 1.5 cm square size and 40 g of the cut moisture-proof paper specimens (2% pulp concentration) was stirred in 2 L of water for 30 minutes.

○: Existence of resin was scarcely observed in the manufactured paper.

X: Adhesion or existence of resin which was not finely dispersed was observed on the manufactured paper.

(3) Bleeding

With respect to the evaluation of bleeding, the occurrence of bleeding was judged by visual observation according to the following standards by heating the manufactured paper at 150° C. for 1 minute in a Geer's oven. The paper observed bleeding in a considerable extent can not be regenerated as a recycle paper since a problem with respect to heat resistance is raised in the steps of manufacturing, drying and secondary processing.

○: Bleeding was not observed.

X: Bleeding was considerably observed.

(4) Antiblocking Property 10 sheets of samples of water-resistant and moisture-proof paper cut into a square having an edge of 5 cm were piled up and left to stand at 50° C. under the pressure of 0.196 MPa (2 Kg/cm$^2$) for 16 hours. After cooled to room temperature, the samples were peeled off one by one with hands and the blocking was evaluated by the following criteria.

○: The samples are peeled off one by one without a sound.

Δ: The samples are peeled off with a slight sound.

X: Part of the water-resistant and moisture-proof layer is peeled off or peeling off is not made easily.

EXAMPLES 2 TO 5

Water-resistant and moisture-proof papers were produced in the same manner as in Example 1 except that resin compositions changing components as shown in Table 1 were used and properties were evaluated. As shown in Table 1, the water-resistant and moisture-proof papers were excellent in moisture permeability, disaggregation and antiblocking property.

The materials which were not used in Example 1 are as follows:

(A3) Propylene-butylene copolymer resin: Vicat softening point (ASTM D 1525): 114° C., MFR (ASTM D 1238, 190° C.): 4 g/10 min.

(A4) Low molecular weight polypropylene: Solution viscosity molecular weight: 21000, melting point: 143° C., density: 0.91 g/cm$^3$.

(B2) Hydrogenated alicyclic petroleum resin: Ring and ball softening point: 135° C., molecular weight: 860, acid value: 0.0.

(C) Compatibilizing agent: Maleic anhydride-modified polypropylene, softening point: 154° C., acid value: 26, number average molecular weight: 40000.

Calcium carbonate: Reagent first grade (heavy calcium carbonate, average particle size: 1 μm or below).

EXAMPLE 6

A coat layer was formed on the water-resistant and moisture-proof layer of the water-resistant and moisture-proof paper produced in Example 1 by applying an aqueous isopropyl alcohol solution of a methyl methacrylate-ethyl acrylate-acrylic acid copolymer (AROLON manufactured by Nippon Shokubai Co., Ltd.) in terms of a solid content of 1.0 g/m, and drying at 80° C. for one minute. The antiblocking property was good and samples were peeled off one by one.

EXAMPLE 7

The resin composition was prepared by heating the resin composition shown in Table 1 at 200 to 210° C. and stirring the melted resin composition enough for respective components to disperse uniformly.

The obtained molten resin composition was applied to a kraft paper of 75 g/m$^2$ using a previously heated Meyer bar in 20 g/m$^2$ thickness, another kraft paper was immediately piled up on the resin composition, then subjected to the pressurization by a calender roll so that a clad paper sample in which the water-resistant and moisture-proof layer was sandwiched by kraft paper substrates was obtained. The adhesive property was so good that if the paper was intended to peel off, the paper substrates were destroyed. As shown in Table 1, both the moisture permeability and the disaggregation were excellent. Meanwhile, front and rear sides of the obtained water-resistant and moisture-proof paper were made of kraft paper, there was no problem with respect to the antiblocking property.

EXAMPLE 8

The water-resistant and moisture-proof paper was prepared in the same manner as in Example 1 except that a penetration-proof agent of a methacrylic acid ester (manufactured by Asahi Chemical Industry Co., Ltd.) was applied in 2 g/m$^2$ thickness to a surface of a kraft paper of 75 g/m$^2$ to be coated with the resin composition of Example 1. The water-resistant and moisture-proof layer of the obtained water-resistant and moisture-proof paper was heated at 200 to 210° C. and another kraft paper (the same as abovementioned but the penetration-proof agent is not applied) was piled up on the heated water-resistant and moisture-proof layer, then pressurized by a calender roll to thus produce a clad paper sample, in which the water-resistant and moisture-proof layer was sandwiched by two sheet of the kraft paper substrates. As shown in Table 1, both the moisture permeability and the disaggregation were excellent. Meanwhile, front and rear sides of the obtained water-resistant and moisture-proof paper were made of kraft paper, there was no problem with respect to the antiblocking property.

COMPARATIVE EXAMPLES 1 TO 3

The water-resistant and moisture-proof papers were prepared in the same manner as in Example 1 except that resin compositions changing components as shown in Table 1 were used. As shown in Table 1, the water-resistant and moisture-proof papers had a fatal drawback at least either in the moisture permeability or in the disaggregation.

COMPARATIVE EXAMPLE 4

The water-resistant and moisture-proof paper was prepared by laminating a low density polyethylene in 20 $\mu$m thickness on a kraft paper of 75 g/m$^2$, and the properties were evaluated. As shown in Table 1, the moisture permeability was so good as 35 g/m$^2$. 24 hr and the antiblocking property was also good. But, in the disaggregation test, water-resistant and moisture-proof layer was not disaggregated at all and the polyethylene film remained unpeeled.

and ball softening point: 135° C., acid value: 1 or lower, and number average molecular weight: 1000) (B3) as the (B) component, and 3 parts of a maleic anhydride-modified polypropylene as the (C) component. The temperature of a dice was set at 170° C.

The obtained pellets were applied to one side of a cup paper of 220 g/m$^2$ thickness using a laminating machine single screw extruder in 30 g/m$^2$ thickness to thus obtain the water-resistant and moisture-proof paper. The temperature of a T-die was set at 210° C.

As the evaluation results being shown in Table 2, the disaggregation in water was excellent and the bleeding caused by heating the manufactured paper was not observed. The obtained water-resistant and moisture-proof paper was cut into the desired fan shape (trunk), circular shape (bottom), and the paper cup was prepared with the water-resistant and moisture-proof layer inside. Heat sealing was made by a hot plate heating method and the heat sealing strength identical to a polyethylene-laminated water-resistant and moisture-proof paper was obtained. Into this paper cup, an aqueous solution colored with Methylene Blue was poured and left to stand at 40° C. for one week, but the permeation of the Methylene Blue into the paper substrate was not observed, from which it was understood that there was no problem with respect to the water-resistance.

In addition, a plate was molded from the pellets of this resin composition using a hot press for the sanitation test

TABLE 1

| | | | Examples | | | | | | | | Comp. Examples | | | |
|---|---|---|---|---|---|---|---|---|---|---|---|---|---|---|
| | | | 1 | 2 | 3 | 4 | 5 | 6 | 7 | 8 | 1 | 2 | 3 | 4 |
| Composition (Parts) | (A1) Amorphous polypropylene (Mw = 70000) | | 40 | 20 | 38 | 40 | 25 | 40 | 40 | 35 | 35 | 65 | 20 | Low density polyethylene laminate |
| | (A2) Crystalline polypropylene resin (MFR = 38) | | 20 | 30 | 25 | | 24 | 20 | 15 | | | 20 | 15 | |
| | (A3) Propylene-butylene copolymer resin (MFR = 4) | | | | | 15 | | | 5 | 20 | | | | |
| | (A4) Low molecular weight polypropylene (Mw = 21000) | | | | | | 20 | | | | | | | |
| | (B1) Terpene-phenol copolymer resin | | 40 | 50 | 35 | 35 | 26 | 40 | 40 | 20 | 35 | 15 | 35 | |
| | (B2) Hydrogenated alicyclic petroleum resin | | | | | 10 | | | | 25 | 30 | | | |
| | (C) Maleic anhydride-modified polypropylene | | | | 2 | | 5 | | | | | | 30 | |
| | Calcium carbonate | | | | | 5 | | | | | | | | |
| | Hindered phenol type antioxidant | | 1 | 1 | 1 | 1 | 1 | 1 | 1 | 1 | 1 | 1 | 1 | |
| Density of resin composition (g/cm$^3$) | | | 0.93 | 0.95 | 0.93 | 1.01 | 0.92 | 0.93 | 0.93 | 0.93 | 0.95 | 0.89 | 0.95 | |
| Penetration-proof layer | | | Absence | | | | | | | Presence | | Absence | | |
| Coat layer | | | Absence | | | | | Presence | | | Absence | | | |
| Properties | Moisture permeability (g/m$^2$ · 24 hr) | Flat | 20 | 22 | 30 | 30 | 25 | 20 | 20 | 23 | 100 | 25 | 100 | 35 |
| | | Cruciform folding | 20 | 40 | 30 | 30 | 40 | 20 | 20 | 23 | 200 | 25 | 300 | — |
| | Disaggregation | Visual observation | ○ | ○ | ○ | ○ | ○ | ○ | ○ | ○ | ○ | X | ○ | X |
| | | Bleeding | ○ | ○ | ○ | ○ | ○ | ○ | ○ | ○ | ○ | X | X | X |
| | Antiblocking | | Δ | ○ | ○ | Δ | ○ | ○ | — | — | X | X | Δ | ○ |

EXAMPLE 9

A resin composition was produced by extruding, kneading and pelletizing by the use of a homodirectional double-screw extruder, a mixture comprising 22 parts of an amorphous polypropylene (homopolymer with weight average molecular weight of 70,000) (A1), 30 parts of a crystalline polypropylene [block type, MFR (JIS K 7210 at 230° C.)=55 g/10 min, melting point=143° C.](A5) as the (A) component, 45 parts of a hydrogenated terpene resin (ring according to a bulletin No. 20 of Ministry of Health and Welfare based on the Food Sanitation Law. The amounts of lead and cadmium were below the inspectable limitation. The dissolved amounts of heavy metals were below the standards.

The consumption of potassium permanganate, and evaporation residues extracted in water, 4% acetic acid and 20% alcohol in an elation test with a pseudo-solvent were all below the standards. Accordingly, the water-resistant and moisture-proof paper of the present invention is usable as cups for meeting these standards.

TABLE 2

| | | | Example 9 |
|---|---|---|---|
| Composition (Parts) | (A1) Amorphous polypropylene (Mw = 70000) | | 22 |
| | (A5) Crystalline polypropylene resin (Block) (MFR = 55) | | 30 |
| | (B3) Hydrogenated terpene resin | | 45 |
| | (C) Maleic anhydride-modified polypropylene | | 3 |
| Density of resin composition (g/cm$^3$) | | | 0.94 |
| Penetration-proof layer | | | Absence |
| Coat layer | | | Absence |
| Properties | Moisture permeability (g/m$^2$ · 24 hr) | Flat | 13 |
| | | Cruciform folding | 13 |
| | Disaggregation | Visual observation | ○ |
| | | Bleeding | ○ |
| | Antiblocking | | ○ |

| | | | Standard | Measured value (ppm) | Judgement |
|---|---|---|---|---|---|
| Sanitation test | Consumption of petassium permanganate | | Not more than 10 ppm | 1.0 | Adaptation |
| | Evaporation residue | water | Not more than 30 ppm | 0.0 | Adaptation |
| | | 4% acetic acid | Not more than 30 ppm | 0.0 | Adaptation |
| | | 20% ethyl alcohol | Not more than 30 ppm | 0.0 | Adaptation |

EXAMPLE 10

A resin composition was produced by extruding, kneading and pelletizing by the use of a homodirectional double-screw extruder, a mixture comprising 40 parts of an amorphous polypropylene resin (homopolymer with weight average molecular weight of 70,000) (A1), 20 parts of a crystalline polypropylene [homopolymer MFR (JIS K 7210 at 230° C.)=38 g/10 min, melting point=157° C.] (A2) as the (A) component, 40 parts of a terpene-phenol copolymer resin (ring and ball softening point: 145° C., acid value: 1 or lower, and number average molecular weight: 1000) (B1) as the (B) component, 100 a parts of calcium carbonate (heavy, average particle size=1 $\mu$m) (D1) as the (D) component, and 1 part of a hindered phenol type antioxidant (melting point: 110 to 125° C.) as a stabilizer. The temperature of a dice was set at 170° C.

The obtained pellets were applied to one side of a kraft paper of 75 g/m$^2$ thickness using a single screw extruder in 20 g/m$^2$ thickness. The temperature of a T-die was set at 220° C.

The moisture permeability, disaggregation in water, and the antiblocking property of the obtained water-resistant and moisture-proof paper were measured by the abovementioned methods. As the results being shown in Table 3, the moisture permeability was excellent in a flat type and a cruciform folding type. Also, the disaggregation in water was excellent and bleeding of the manufactured paper by heating was not observed. Moreover, with respect to the antiblocking property, blocking was slightly observed.

The liquid (filtrate after a pulp component was used for paper making) was diluted to 0.5% of a pulp concentration in the actual paper making process for the measurement of COD and BOD. The COD was 2.5 ppm and the BOD was 2 ppm which were identical to the values in the case where only kraft paper was treated in the same manner. This indicates that the water-resistant and moisture-proof paper using the resin composition of the present invention does not callow oxidative substances and organic compounds to dissolve into water during the disaggregation.

EXAMPLES 11 TO 13

Water-resistant and moisture-proof papers were produced in the same manner as in Example 10 except that resin compositions changing components as shown in Table 3 were used and properties were evaluated. As shown in Table 3, the water-resistant and moisture-proof papers were excellent in moisture permeability, disaggregation and antiblocking property.

The materials which were not used in Example 10 are as follows:

(A4) Low molecular weight polypropylene: Solution viscosity molecular weight: 21000, melting point: 143° C., density: 0.91 g/cm$^3$.

(A5) Crystalline polypropylene resin: Homopolymer, weight average molecular weight: 100000, MFR (JIS K 7210 at 230° C.): 650 g/10 min.

(A6) Amorphous (propylene-butene-1) copolymer resin: weight average molecular weight: 80000, ring and ball softening point: 110° C., Tg: −26° C.

(B2) Hydrogenated alicyclic petroleum resin: Ring and ball softening point: 135° C., molecular weight: 860, acid value: 0.0.

(C) Compatibilizing agent: Maleic anhydride-modified polypropylene, softening point: 154° C., acid value: 26, number average molecular weight: 40000.

EXAMPLE 14

A coat layer was formed on the water-resistant and moisture-proof layer of the water-resistant and moisture-proof paper produced in Example 10 by applying an aqueous solution obtained by mixing 100 parts of calcium carbonate used in Example 10 with 100 parts of an aqueous isopropyl alcohol solution of a methyl methacrylate-ethyl acrylate-acrylic acid copolymer (AROLON manufactured by Nippon Shokubai Co., Ltd.) and diluting with water in terms of a solid content of 1.0 g/m$^2$, and drying at 80° C. for one minute. The antiblocking property was good and samples were peeled off one by one.

EXAMPLE 15

The water-resistant and moisture-proof paper was prepared in the same manner as in Example 10 except that a penetration-proof agent of a methacrylic acid ester (manufactured by Asahi Chemical Industry Co., Ltd.) was applied to a surface of a kraft paper of 75 g/m$^2$ to be coated with the resin composition of Example 10 in 2 g/m$^2$ thickness. The water-resistant and moisture-proof layer of the obtained water-resistant and moisture-proof paper was heated at 200 to 210° C. and another kraft paper (the same as above-mentioned but the penetration-proof agent is not applied) was piled up on the heated water-resistant and moisture-proof layer, then pressurized by a calender roll to thus produce a clad paper sample in which the water-resistant and moisture-proof layer was sandwiched by two sheet of the kraft paper substrates. As shown in Table 3, both the moisture permeability and the disaggregation were excellent. Meanwhile, front and rear sides of the obtained water-resistant and moisture-proof paper were made of kraft paper, there was no problem with respect to the antiblocking property.

COMPARATIVE EXAMPLES 5 TO 7

The water-resistant and moisture-proof papers were prepared in the same manner as in Example 10 except that resin compositions changing components as shown in Table 3 were used. As shown in Table 3, the water-resistant and moisture-proof papers had a fatal drawback at least either in the moisture permeability or in the disaggregation.

COMPARATIVE EXAMPLE 8

The water-resistant and moisture-proof paper was prepared by laminating a low density polyethylene in 20 μm thickness on a kraft paper of 75 g/m$^2$, and the properties were evaluated. As shown in Table 3, the moisture permeability was so good as 35 g/m$^2$.24 hr and the antiblocking property was also good. But, in the disaggregation test, the water-resistant and moisture-proof layer was not disaggregated at all and the polyethylene film remained unpeeled.

TABLE 3

| | | | Examples | | | | | | Comp. Examples | | | |
|---|---|---|---|---|---|---|---|---|---|---|---|---|
| | | | 10 | 11 | 12 | 13 | 14 | 15 | 5 | 6 | 7 | 8 |
| Composition (Parts) | (A1) Amorphous polypropylene (Mw = 70000) | | 40 | | | | 40 | 40 | 30 | | 40 | Low density polyethylene laminate |
| | (A2) Crystalline polypropylene resin (MFR = 38) | | 20 | | 20 | | 20 | 20 | | 10 | 40 | |
| | (A4) Low molecular weight polypropylene (Mw = 21000) | | | | 10 | | | | | | | |
| | (A5) Crystalline polypropylene resin (MFR = 650) | | | 50 | | 20 | | | | | | |
| | (A6) Amorphous (propylene-butene) copolymer | | | | 30 | 25 | | | | 20 | | |
| | (B1) Terpene-phenol copolymer resin | | 40 | 50 | | 50 | 40 | 40 | 70 | | 20 | |
| | (B2) Hydrogenated alicyclic petroleum resin | | | | 35 | | | | | 40 | | |
| | (C) Maleic anhydride-modified polypropylene | | | | 5 | 5 | | | | 30 | | |
| | (D1) Calcium carbonate (Average particle size 1 μm) | | 100 | 50 | 50 | 150 | 100 | 100 | 100 | 100 | 400 | |
| | Hindered phenol type antioxidant | | 1 | 1 | 1 | 1 | 1 | 1 | 1 | 1 | 1 | |
| Penetration-proof layer | | | Absence | | | | | Presence | Absence | | | |
| Coat layer | | | Absence | | | | Presence | | Absence | | | |
| Properties | Moisture permeability (g/m$^2$ · 24 hr) | Flat | 28 | 20 | 20 | 22 | 28 | 23 | 50 | 40 | 200 | 35 |
| | | Cruciform folding | 30 | 24 | 20 | 22 | 30 | 23 | 700 | 60 | 800 | — |
| | Disaggregation | Visual observation | ○ | ○ | ○ | ○ | ○ | ○ | ○ | ○ | X | X |
| | | Bleeding | ○ | ○ | ○ | ○ | ○ | ○ | ○ | X | X | X |
| | Antiblocking | | Δ | ○ | ○ | ○ | ○ | — | Δ | X | ○ | ○ |

EXAMPLE 16

A resin composition was produced by extruding, kneading and pelletizing by the use of a homodirectional double-screw extruder, a mixture comprising 22 parts of an amorphous polypropylene (homopolymer with weight average molecular weight of 70,000) (A1), 30 parts of a crystalline polypropylene [block type, MFR (JIS K 7210 at 230° C.)=55 g/10 min, melting point=143° C.] (A7) as the (A) component, 45 parts of a hydrogenated terpene resin (ring and ball softening point: 135° C., acid value: 1 or lower, and number average molecular weight: 1000) (B3) as the (B) component, 3 parts of a maleic anhydride-modified polypropylene as the (C) component, kaolin (average:article size: 1 μm)(D2) as the (D) component, and 1 part of a hindered phenol antioxidant (melting point: 110 to 125° C.). The temperature of a dice was set at 180° C.

The obtained pellets were applied to one side of a cup paper (virgin pulp 100%) of 220 g/m$^2$ thickness using a laminating machine single screw extruder in 30 g/m$^2$ thickness to thus obtain the water-resistant and moisture-proof paper. The temperature of a T-die was set at 230° C.

As the evaluation results being shown in Table 4, the disaggregation in water was excellent and the bleeding caused by heating the manufactured paper was not observed. The obtained water-resistant and moisture-proof paper was cut into the desired fan shape (trunk), circular shape (bottom), and the paper cup was prepared with the water-resistant and moisture-proof layer inside. Heat sealing was made by a hot plate heating method and the heat sealing strength identical to a polyethylene-laminated water-resistant and moisture-proof paper was obtained. Into this paper cup, an aqueous solution colored with Methylene Blue was poured and left to stand at 40° C. for one week, but the permeation of the Methylene Blue into the paper substrate was not observed, from which it was understood that there was no problem with respect to the water-resistance.

In addition, a plate was molded from the pellets of this resin composition using a hot press for the sanitation test according to a bulletin No. 20 of Ministry of Health and Welfare based on the Food Sanitation Law. The amounts of lead and cadmium were below the inspectable limitation. The dissolved amounts of heavy metals were below the standards.

The consumption of potassium permanganate, and evaporation residues extracted in water, 4% acetic acid and 20% alcohol in an elution test with a pseudo-solvent were all below the standards. Accordingly, the water-resistant and moisture-proof paper of the present invention is usable as cups for meeting these standards.

TABLE 4

| | | | Example 16 |
|---|---|---|---|
| Composition (Parts) | (A1) Amorphous polypropylene (Mw = 70000) | | 22 |
| | (A7) Crystalline polypropylene resin (Block) (MFR = 55) | | 30 |
| | (B3) Hydrogenated terpene resin | | 45 |
| | (C) Maleic anhydride-modified polypropylene | | 3 |
| | (D2) Kaolin (Average particle size 1 μm) | | 100 |
| | Hindered phenol type antioxidant | | 1 |
| Penetration-proof layer | | | Absence |
| Coat layer | | | Absence |
| Properties | Moisture permeability (g/m$^2$ · 24 hr) | Flat | 15 |
| | | Cruciform folding | 15 |
| | Disaggregation | Visual observation | ○ |
| | | Bleeding | ○ |
| | Antiblocking | | ○ |

TABLE 4-continued

| | | | Standard | Measured value (ppm) | Judgement |
|---|---|---|---|---|---|
| Sanitation test | Consumption of petassium permanganate | | Not more than 10 ppm | 1.0 | Adaptation |
| | Evaporation residue | water | Not more than 30 ppm | 0.7 | Adaptation |
| | | 20% ethyl alcohol | Not more than 30 ppm | 0.5 | Adaptation |

INDUSTRIAL APPLICABILITY

As described above, the water-resistant and moisture-proof paper using the resin composition of the present invention as the water-resistant and moisture-proof layer has the water-resistance and moisture-proofness as excellent as or even more excellent than that of the water-resistant and moisture-proof paper laminated with a polyolefin type resin.

Also, the moisture-proof paper of the present invention has disaggregation and dispersibility in water as excellent as that of emulsion-coated type moisture-proof paper, which has recently been proposed, and is possible to be recycled without bleeding by heating after paper manufacturing.

Moreover, a load is not increased on the waste water treatment at the time of paper manufacturing. Further, the resin composition is cheaper than the conventional one and a manufacturing equipment is also cheap. The working efficiency is also high. Especially, by using a specific amount of an inorganic filler, a more cheaper resin composition is not only obtained, but the problems caused by a relatively large amount of an inorganic filler used, such as a decrease in moisture-proofness of the folded lines and damages on the surface of products wrapped are solved.

The present invention provides remarkably useful water-resistant and moisture-proof paper as a water-resistant and moisture-proof wrapping paper for industrial products and water-resistant and moisture-proof container materials for domestic goods and at the same time contributes to wood resource preservation by recycling and environmental pollution prevention, since burning and discarding of paper materials are not required.

What is claimed is:

1. A resin composition for water-resistant and moisture-proof paper comprising 40 to 75 parts by weight of a polyolefin (A), 25 to 60 parts by weight of a tackifier (B), and greater than 0 to not more than 20 parts by weight of at least one compatibilizing agent (C), the total of (A), (B) and (C) being 100 parts by weight, wherein said compatibilizing agent (C) does not comprise an acid modified polyolefin.

2. The resin composition for water-resistant and moisture-proof paper of claim 1, said compatibilizing agent (C) is selected from the group consisting of oxidized polyolefins, hydrogenated styrene-butadiene resins, styrene-ethylene butylene-olefin block copolymer resins and olefin-ethylene butylene-olefin block copolymer resins.

3. The resin composition for water-resistant and moisture-proof paper of claim 1, further comprising: at least one sheet of a paper substrate having said resin composition provided directly on at least one side of said sheet, to form a resin composition layer, and a (meth)acrylic resin layer formed on the resin composition layer.

4. A resin composition for water-resistant and moisture-proof paper of claim 1, further comprising 20 to 300 parts by weight of an inorganic filler (D) to the total amount of 100 parts by weight of (A), (B) and (C).

5. The resin composition of claim 1, wherein said polyolefin (A) comprises at least one amorphous polypropylene resin.

6. The resin composition of claim 5, wherein said amorphous polypropylene resin comprises a polypropylene homopolymer or a copolymer of propylene, with at least one selected from the group consisting of ethylene and alpha-olefins.

7. The resin composition of claim 1, wherein said tackifier (B) comprises at least one member selected from the group consisting of rosin, modified rosins, ester compounds thereof, alkylphenol reins, alkylphenol-modified xylene resins, rosin-modified xylene resins, terpene phenol resins, terpene resins, aromatic-modified terpene resins, olefin resins, styrene resins, petroleum resins, hydrogenated petroleum resins and coumarone-indene resins.

8. The resin composition of claim 7, wherein said tackifier (B) comprises at least one member selected from the group consisting of hydrogenated alicyclic petroleum resins, hydrogenated terpene resins and hydrogenated rosin esters.

9. The resin composition of claim 4, wherein said inorganic filler (D) has an average particles size of not larger than 5 $\mu$m.

10. The resin composition of claim 9, wherein said inorganic filler (D) is one selected from the group consisting of calcium carbonate, kaolin and clay, having an average particle size of not larger than 5 $\mu$m.

11. The resin composition of claim 4, wherein said inorganic filler (D) is blended so that a density of the rein composition is not less than 1.0 g/cm$^3$.

12. The resin composition of claim 1, which is colored with the same color as a paper substrate.

13. A water-resistant and moisture-proof paper, comprising: the resin composition of claim 1, provided between at least two sheets of a paper substrate.

14. A water-resistant and moisture-proof paper, comprising: the resin composition of claim 1, provided on at least one side of a paper substrate.

15. The water-resistant and moisture-proof paper of any one of claims 13 or 14, said resin composition further comprising: 20 to 300 parts by weight of an inorganic filler (D) to the total amount of 100 parts by weight of (A), (B), and (C).

16. The water-resistant and moisture-proof paper of any one of claim 13 or 14, wherein a coat layer of a (meth)acrylic resin is formed on the water-resistant and moisture-proof layer.

17. The water-resistant and moisture-proof paper of claim 16, wherein a penetration-proof layer is formed on a face of the paper substrates to be contacted with the resin composition and/or on a face of another counterpart paper substrate to be brought into contact with the resin composition.

18. The water-resistant and moisture proof paper of any one of claims 13 or 14, further comprising at least one penetration-proof layer provided between at least one sheet of said paper substrate and said resin composition layer.

19. A method for producing water-resistant and moisture-proof paper, comprising the step of applying the resin composition defined in claim 1, to at least one side of a paper substrate, to form a water-resistant and moisture-proof layer.

20. A method for producing a moisture-proof paper, comprising the step of applying the resin composition defined in claim 1, between at least two sheets of a paper substrate, to form a water-resistant and moisture-proof layer.

21. The method for producing a water-resistant and moisture-proof paper of any one of claims 19 or 20, further comprising applying a penetration-proof layer between at least one sheet of said paper substrate and said resin composition.

22. A method for producing water-resistant and moisture-proof paper, comprising the steps of:

applying said resin composition defined in claim 1, to at least one side of a paper substrate to form a moisture-proof layer, and forming a coat layer of a (meth)acrylic resin on the surface of the water-resistant and moisture-proof layer.

23. The method for producing a water-resistant and moisture-proof paper of claim 22, further comprising applying at least one penetration-proof layer between said paper substrate and said resin composition.

24. The resin composition of any one of claims 1 or 4, wherein said compatibilizing agent (C) is present in an amount of 1 to 7 parts by weight.

25. A water-resistant and moisture-proof paper, consisting of:

a resin composition comprising:

40 to 75 parts by weight of a polyolefin (A);

25 to 60 parts by weight of a tackifier (B);

greater than 0 to not more than 20 parts by weight of a compatibilizing agent (C), the total of (A), (B), and (C), being 100 parts by weight; and optionally 20 to 300 parts by weight of an inorganic filler (D) to the total amount of 100 parts by weight of (A), (B), and (C), to form said resin composition;

one or more sheets of a paper substrate;

one or more penetration-proof layers formed on a face of at least one sheet of said paper substrate;

one or more resin composition layers provided on said penetration-proof layer, and/or provided on another sheet of said paper substrate such that said resin composition layer is in contact with said penetration-proof layer on a different sheet of substrate; and optionally one or more (meth)acrylic resin layers formed on said one or more resin composition layers.

26. The water-resistant and moisture-proof paper of any one of claims 13, 14, or 25, wherein said compatibilizing agent (C) is present in an amount of 1 to 7 parts by weight.

27. A method for producing water-resistant and moisture-proof paper, comprising the steps of:

applying a resin composition, comprising 40 to 75 parts by weight of a polyolefin (A), 25 to 60 parts by weight of a tackifier (B) and 0 to 20 parts by weight of a compatibilizing agent (C), the total of (A), (B) and (C) being 100 parts by weight, to at least one side of a paper substrate, to form a water-resistant and moisture-proof layer, and forming a coat layer of a (meth)acrylic resin on the surface of the water-resistant and moisture-proof layer.

28. A method for producing a water-resistant moisture-proof paper, consisting of:

applying a penetration-proof agent to a face of one or more sheets of a paper substrate to form one or more penetration-proof layers;

applying a resin composition to said one or more penetration-proof layers to form one or more resin composition layers, and/or to a face of another sheet of said paper substrate to form one or more resin composition layers such that said resin composition is in communication with said penetration-proof layer provided on a different sheet of substrate, and optionally forming one or more (meth)acrylic resin layers on said one or more resin composition layers, said resin composition comprises 40 to 75 parts by weight of a polyolefin (A); 25 to 60 parts by weight of a tackifier (B); greater than 0 to not more than 20 parts by weight of a compatibilizing agent (C), the total of (A), (B), and (C), being 100 parts by weight and optionally 20 to 300 parts by weight of an inorganic filler to a total amount of 100 parts by weight of (A), (B), and (C).

29. The method for producing a water-resistant and moisture-proof paper of anyone of claims 27, 28, and 19, wherein said compatibilizing agent (C) is present in an amount of 1 to 7 parts by weight.

30. A resin composition for water-resistant and moisture-proof paper, comprising 40 to 75 pails by weight of a polyolefin (A), 25 to 60 parts by weight of a tackifier (1) and 0 to 20 parts by weight of at least one compatibilizing agent (C), the total of (A), (B) and (C) being 100 parts by weight wherein said resin composition is colored with the same color as a paper substrate.

31. A water-resistant and moisture-proof paper, comprising: a resin composition comprising 40 to 75 parts by weight of a polyolefin (A), 25 to 60 parts by weight of a tackifier (B), 0 to 20 parts by weight of a compatibilizing agent (C), the total of (A), (B), and (C), being 100 parts by weight, and 20 to 300 pans by weight of an inorganic filler (D) to the total amount of 100 parts by weight of (A), (B), and (C), said resin composition is provided between at least two sheets of a paper substrate.

32. A water-resistant and moisture-proof paper, comprising: a resin composition comprising 40 to 75 parts by weight of a polyolefin (A), 25 to 60 parts by weight of a tackifier (B), 0 to 20 parts by weight of a compatibilizing agent (C), the total of (A), (B), and (C), being 100 parts by weight, and 20 to 300 parts by weight of an inorganic filler (1) to the total amount of 100 parts by weight of (A), (B), and (C), said resin composition provided directly on at least one side of a paper substrate.

33. A water-resistant and moisture-proof paper, comprising: a paper substrate having a water-resistant and moisture-proof resin composition layer formed directly on at least one side of said paper substrate, said resin composition, comprising: 40 to 75 parts by weight of a polyolefin (A), 25 to 60 parts by weight of a tackifier (B) and 0 to 20 parts by weight of a compatibilizing agent (C), the total of (A), (B) and (C) being 100 parts by weight, and a coat layer of a (meth)acrylic resin formed on the water-resistant and moisture-proof layer.

34. The water-resistant and moisture-proof paper of claim 33, wherein a penetration-proof layer is formed on a face of the paper substrates to be contacted with the resin composition and/or on a face of another counterpart paper substrate to be brought into contact with the resin composition.

* * * * *